US010627147B2

(12) United States Patent
McCollough et al.

(10) Patent No.: US 10,627,147 B2
(45) Date of Patent: Apr. 21, 2020

(54) FILL SECTION HEATER FOR A REFRIGERATION APPLIANCE

(71) Applicant: Electrolux Home Products, Inc., Charlotte, NC (US)

(72) Inventors: Thomas McCollough, Anderson, SC (US); Lisa French, Anderson, SC (US)

(73) Assignee: Electrolux Home Products, Inc., Charlotte, NC (US)

( * ) Notice: Subject to any disclaimer, the term of this patent is extended or adjusted under 35 U.S.C. 154(b) by 166 days.

(21) Appl. No.: 15/134,491

(22) Filed: Apr. 21, 2016

(65) Prior Publication Data

US 2017/0307275 A1 Oct. 26, 2017

(51) Int. Cl.

| | |
|---|---|
| ***F25C 1/04*** | (2018.01) |
| ***F25C 5/08*** | (2006.01) |
| *F25C 1/25* | (2018.01) |
| *B67D 3/00* | (2006.01) |
| *F25C 1/08* | (2006.01) |
| *B67D 1/08* | (2006.01) |

(52) U.S. Cl.

CPC ..... *F25C 5/08* (2013.01); *F25C 1/04* (2013.01); *B67D 1/0895* (2013.01); *B67D 3/0022* (2013.01); *F25C 1/08* (2013.01); *F25C 1/25* (2018.01); *F25C 2400/02* (2013.01); *F25C 2400/10* (2013.01); *F25C 2400/14* (2013.01); *F25D 2323/122* (2013.01)

(58) Field of Classification Search

CPC ..... F25C 2400/14; F25C 1/04; F25C 1/25; F25C 1/08; F25C 2400/10; F25C 2400/02; F25D 2323/122; B67D 1/0895; B67D 3/0022

See application file for complete search history.

(56) References Cited

U.S. PATENT DOCUMENTS 3,835,661 A 9/1974 Kochendorfer et al.
3,866,434 A 2/1975 Pugh et al.
(Continued)

FOREIGN PATENT DOCUMENTS

EP 2604954 A2 * 6/2013 ..... F25C 1/25

OTHER PUBLICATIONS

Melissa Hiatt, DIY—Fix Your Refrigerator Water Dispenser, Jun. 18, 2013, makingitsweet.*
GE Consumer & Industrial, Water Line Freezing, Oct. 2017.*

*Primary Examiner* — Frantz F Jules
*Assistant Examiner* — Lionel Nouketcha
(74) *Attorney, Agent, or Firm* — Pearne & Gordon LLP

(57) ABSTRACT

A refrigeration appliance includes an ice maker is disposed within a freezer compartment. The ice maker includes a water fill assembly for conveying water from a source of pressurized water to an ice tray. The water fill assembly includes a water fill tube fluidly connected to the source of pressurized water. A removable fill and heater assembly includes a plate disposed above the ice tray of the ice maker. The plate has an opening positioned above the ice tray. A shroud extends from an upper surface of the plate and has an inlet end fluidly communicating with the water fill tube. An outlet end of the shroud directs water into the ice tray in a predetermined direction. A heating element is disposed on the upper surface of the plate for applying heat to the plate to maintain a portion of the plate at a temperature in excess of 0° C.

19 Claims, 11 Drawing Sheets

(56) References Cited

U.S. PATENT DOCUMENTS

| | | | | |
|---|---|---|---|---|
| 4,142,373 | A * | 3/1979 | Weibel, Jr. | F25C 1/04 62/138 |
| 4,142,378 | A | 3/1979 | Bright et al. | |
| 4,197,449 | A | 4/1980 | Fessenden | |
| 6,148,624 | A | 11/2000 | Bishop et al. | |
| 6,157,777 | A * | 12/2000 | Banks | F24H 1/142 219/536 |
| 6,490,873 | B2 | 12/2002 | Tchougounov et al. | |
| 6,725,685 | B2 | 4/2004 | Kang | |
| 6,735,974 | B2 | 5/2004 | Oh | |
| 7,568,354 | B2 | 8/2009 | Coulter et al. | |
| 8,413,459 | B2 | 4/2013 | Kim et al. | |
| 8,534,089 | B2 | 9/2013 | An et al. | |
| 8,667,808 | B2 | 3/2014 | Kim et al. | |
| 8,769,981 | B2 | 7/2014 | Hong et al. | |
| 8,800,315 | B2 | 8/2014 | Kim et al. | |
| 2007/0012061 | A1* | 1/2007 | Ribeiro | F25C 1/22 62/344 |
| 2009/0308085 | A1 | 12/2009 | DeVos | |
| 2009/0314024 | A1* | 12/2009 | Choi | F25C 5/22 62/347 |
| 2010/0024442 | A1* | 2/2010 | Damrath | F25C 1/00 62/66 |
| 2011/0185759 | A1* | 8/2011 | Kang | F25C 5/22 62/340 |
| 2011/0289949 | A1 | 12/2011 | Bai et al. | |
| 2012/0000899 | A1 | 1/2012 | Eom et al. | |
| 2012/0031138 | A1 | 2/2012 | Hunter | |
| 2014/0190281 | A1* | 7/2014 | Crosby | F16B 17/00 73/866.5 |
| 2015/0300717 | A1* | 10/2015 | Gaplikow | F25C 5/22 62/340 |

* cited by examiner

FILL SECTION HEATER FOR A REFRIGERATION APPLIANCE

FIELD OF THE INVENTION

This application relates generally to an ice maker for a refrigeration appliance, and more particularly, to a refrigeration appliance including an ice maker disposed within a freezer compartment of a refrigerator that is maintained at a temperature below a freezing temperature of water at atmospheric conditions.

BACKGROUND OF THE INVENTION

Conventional side-by-side refrigeration appliances, such as domestic refrigerators, place an ice maker within the freezer compartment. The ice maker includes an ice tray wherein ice cubes are formed. A water fill line is connected at one end to a source of pressurize water and at another end to the ice maker. An outlet end of the water fill line is positioned above the ice tray to inject water into the ice tray. However, because the temperature in the ice maker is below freezing, residual water left at the outlet end of the water fill line may freeze and form an "ice dam." Over time, the ice dam may grow and obstruct the flow of water from the water fill line. The ice dam may also cause the water exiting the water fill line to spray and create unwanted ice formations within the ice maker. The foregoing may necessitate service visits from maintenance personnel to remove the ice dams and/or replace components of the ice maker.

Accordingly, there is a need in the art for a refrigerator wherein an ice maker disposed within a freezer compartment of the refrigerator is designed to reduce the likelihood of ice dams forming at an outlet of a water line.

BRIEF SUMMARY OF THE INVENTION

In accordance with one aspect, a refrigeration appliance includes a freezer compartment for storing food items in a sub-freezing environment having a target temperature below zero degrees Centigrade. An ice maker is disposed within the freezer compartment for freezing water into ice pieces. The ice maker includes a water fill assembly for conveying water from a source of pressurized water to an ice tray disposed in the ice maker. The water fill assembly includes a water fill tube having an inlet end fluidly connected to the source of pressurized water and an outlet end. A removable fill and heater assembly includes a plate disposed above the ice tray of the ice maker. The plate has an opening positioned above the ice tray. A shroud extends from an upper surface of the plate about an outer periphery of the opening in the plate. The shroud defines a flow channel that extends from an inlet end to an outlet end of the shroud. The inlet end of the shroud fluidly communicates with the outlet end of the water fill tube and the outlet end of the shroud is oriented toward the ice tray for directing water into the ice tray in a predetermined direction. A heating element is disposed on the upper surface of the plate for applying heat to the plate thereby maintaining at least a portion of the plate at a temperature in excess of zero degrees Centigrade.

In accordance with another aspect, a method of making ice in a refrigeration appliance, includes the steps of: introducing water into a shroud, the shroud defining a flow channel that extends from an inlet end to an outlet end of the shroud, the outlet end of the shroud disposed about an outer periphery of an opening extending through a plate, the opening in the plate being positioned above an ice tray disposed within an ice maker wherein water supplied to the inlet end of the shroud flows along the flow channel of the shroud to the outlet end of the shroud and into the ice tray; and heating the plate to a temperature sufficient to prevent water from forming ice about the opening extending through the plate.

DESCRIPTION OF EXAMPLE EMBODIMENT

Figure 1:
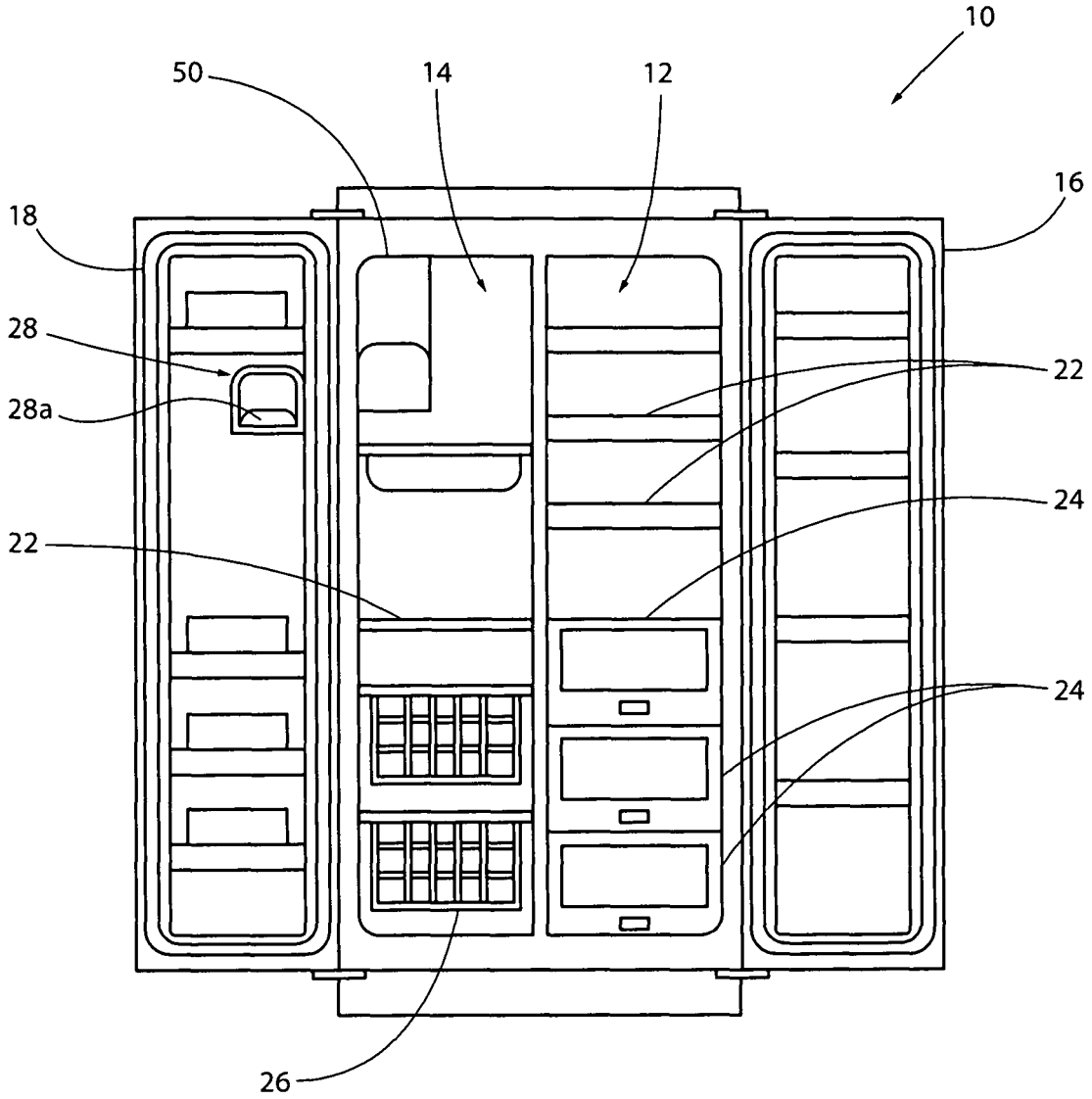
PRIOR ART FIG. 1
FIG. 1 is a front elevational view of a household side-by-side refrigerator showing doors of the refrigerator in an open position.

Referring now to the drawings, FIG. 1 shows a typical household refrigerator 10 comprising a fresh food compartment 12 and a freezer compartment 14. A door 16, shown in FIG. 1 as open, is mounted to the refrigerator body by hinges and serves to close the front of the fresh food compartment 12 as well as provide access to the interior of the fresh food compartment 12. A door 18 is mounted to a body of the refrigerator 10 by hinges and serves to close the front of the freezer compartment 14 as well as provide access to the interior of the freezer compartment 14. The fresh food and freezer compartments 12, 14 can include a variety of shelves 22, closed drawers 24 and basket-like drawers 26 for storing articles of food and the like.

A dispenser (not shown) for dispensing at least ice pieces, and optionally water, is provided on door 18. The dispenser includes a lever, switch, proximity sensor or other device that a user interacts with to cause frozen ice pieces to be dispensed from an ice maker 50 disposed within the freezer compartment 14 through the door 18. An ice chute 28 is formed in door 18. The ice chute 28 includes an aperture **28*a* that is positioned and dimensioned to be in registry with an outlet of the ice maker 50 when the door 18 is in the closed position. The ice pieces from the ice maker 50 are delivered to the dispenser via the ice chute 28, which extends at least partially through the door 18 between the dispenser and the ice maker 50**.

The fresh food compartment 12 serves to minimize spoiling of articles of food stored therein by maintaining the temperature in the fresh food compartment 12 during operation at a cool temperature that is typically less than an ambient temperature of the refrigerator 10, but somewhat above 0° C., so as not to freeze the articles of food in the fresh food compartment 12. An evaporator is used to separately maintain the temperature within the fresh food compartment 12 independent of the freezer compartment 14. According to an embodiment, the temperature in the fresh food compartment 12 is maintained at a cool temperature within a close tolerance of a range between 0° C. and 4.5° C., including any subranges and any individual temperatures falling with that range. For example, other embodiments optionally maintain the cool temperature within the fresh food compartment 12 within a reasonably close tolerance of a temperature between 0.25° C. and 4° C.

The freezer compartment 14 is used to freeze and/or maintain articles of food stored in the freezer compartment 14 in a frozen condition. For this purpose, an evaporator (not shown) provides a cooling effect to the freezer compartment 14. The evaporator is supported within the freezer compartment 14, and an electric fan (not shown) is located adjacent to the evaporator. Operation of the electric fan draws the airflow upward over the fins and coils of the evaporator, and then in a forward direction, generally parallel to the ceiling portion of the freezer compartment 14 and toward a front of the freezer compartment 14.

Figure 3:
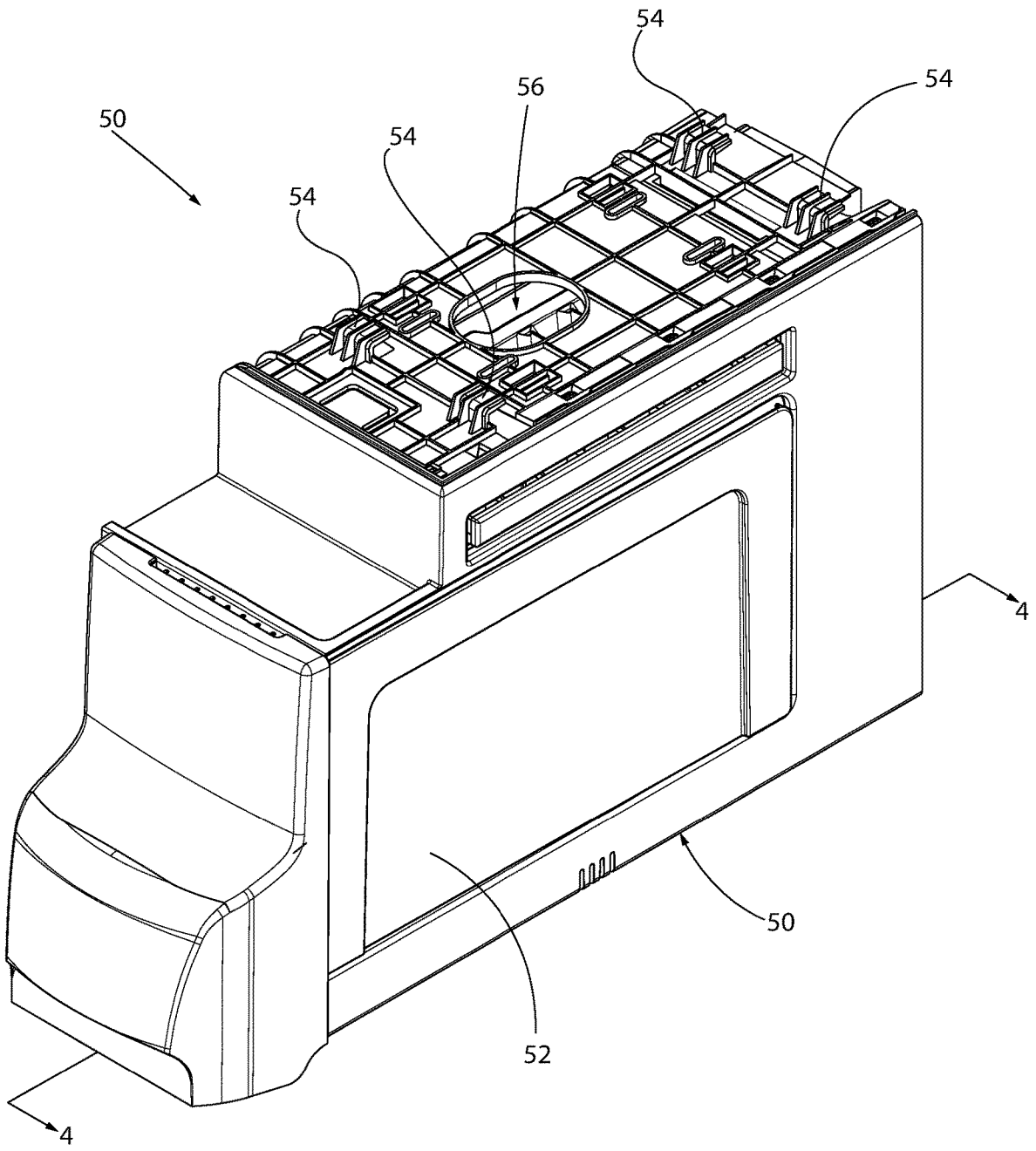
FIG. 3 is a perspective view of an ice maker of FIG. 1.

The evaporator also reduces a temperature of the air within the ice maker 50 (FIG. 3) for freezing water into the ice pieces and for maintaining a temperature in an ice bin 52 of the ice maker 50. In one example, the refrigeration circuit includes a variable-speed compressor for compressing gaseous refrigerant to a high-pressure refrigerant gas. The compressor may be infinitely variable, or vary between a plurality of predetermined, discrete operational speeds depending on the demand for cooling. The high-pressure refrigerant gas from the compressor is conveyed through a suitable conduit such as a copper tube to a condenser, which cools the high-pressure refrigerant gas and causes it to at least partially condense into a liquid refrigerant.

Figure 2:
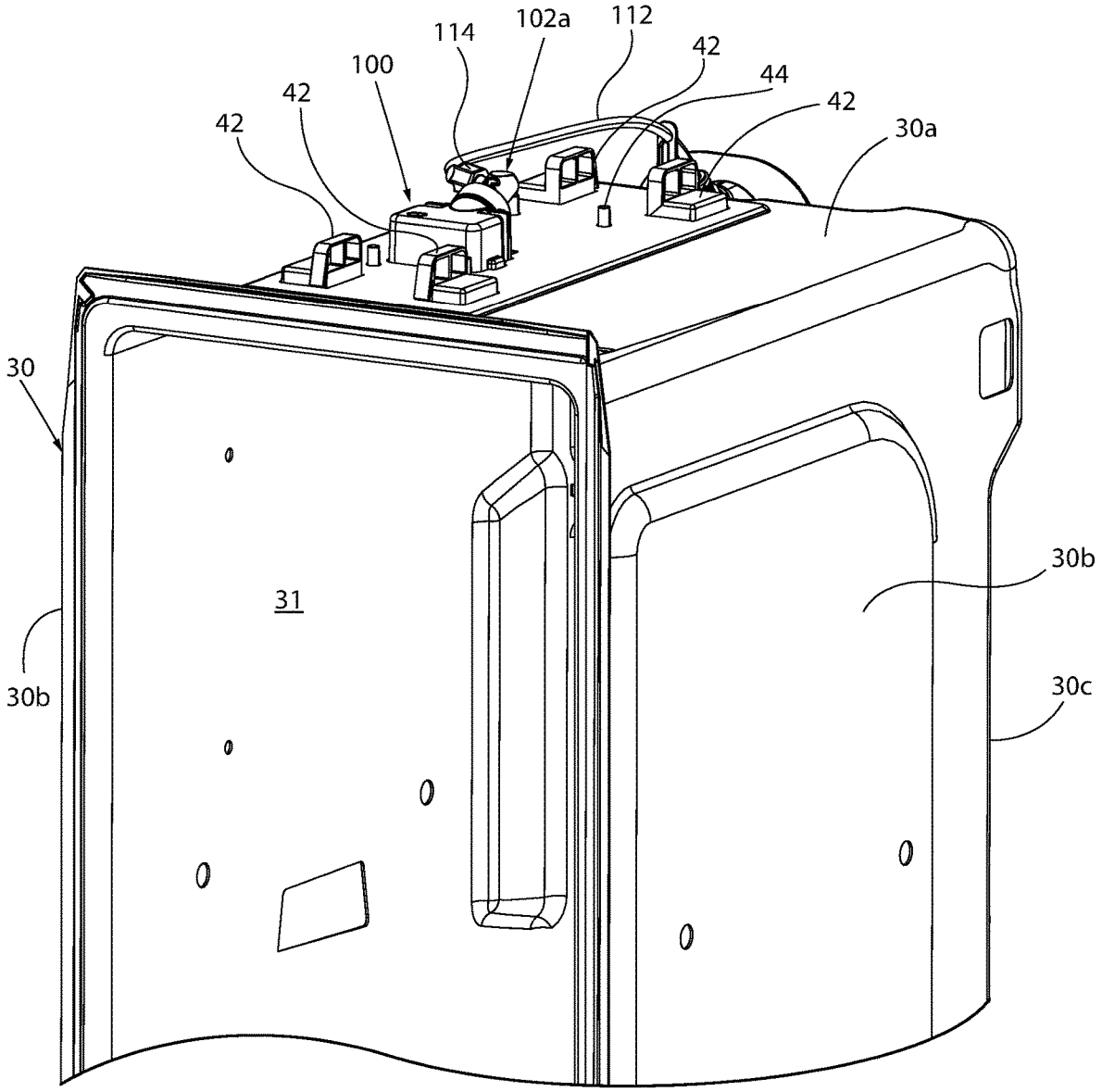
FIG. 2 is a perspective view of an upper portion of a freezer compartment housing of FIG. 1.
Figure 5:
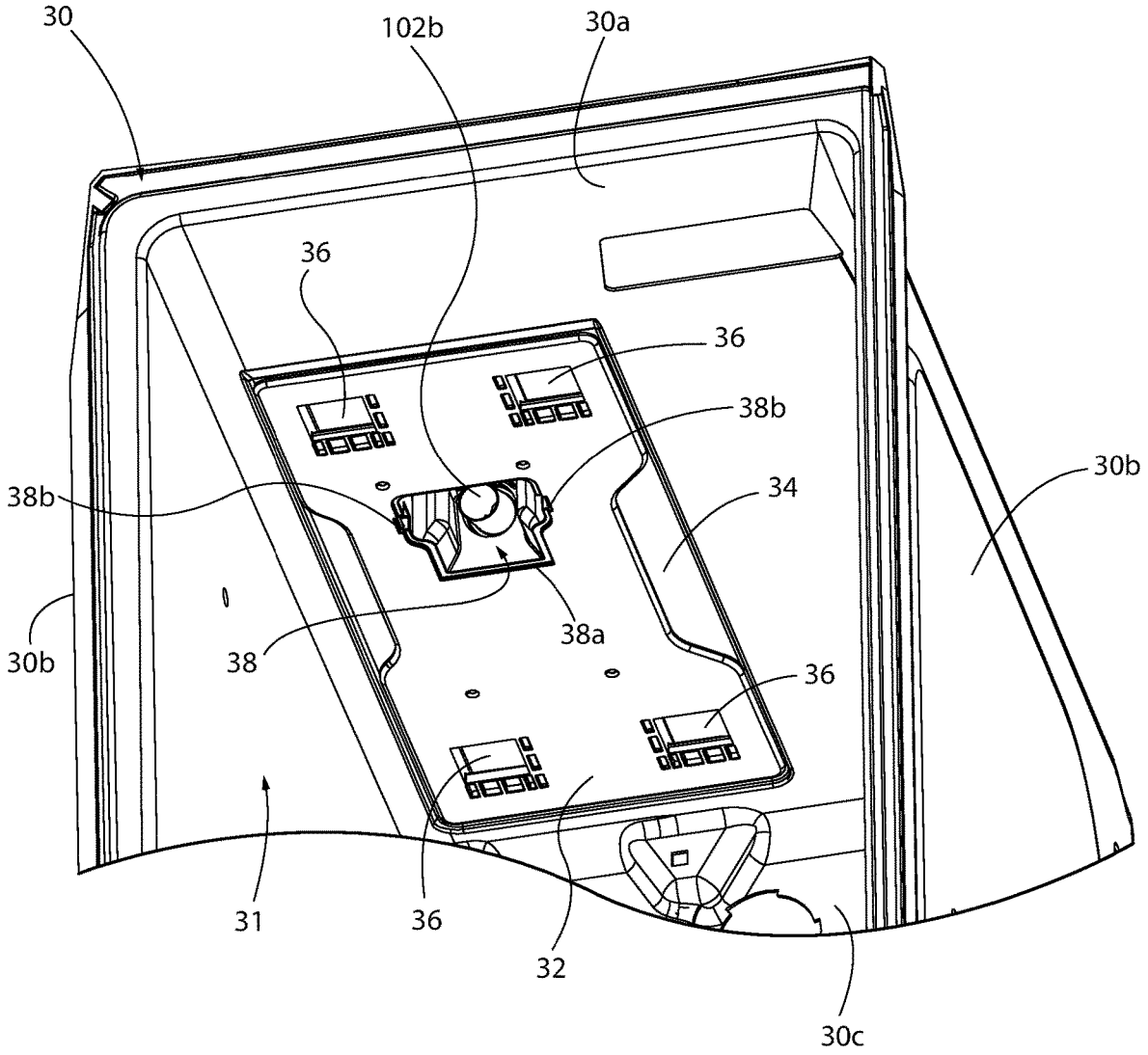
FIG. 5 is a perspective view of an upper, inner wall of the freezer compartment housing of FIG. 2.

The freezer compartment 14, in general, includes a housing 30 (which is sometimes referred to as an interior liner), an ice maker 50 and a water fill assembly 100 for the ice maker 50. Referring now to FIG. 2, the housing 30 is best seen. The housing 30 is a molded structure that includes an upper wall 30*a*, side walls 30*b*, a lower wall (not shown) and a rear wall 30*c* that together define an internal chamber 31 of the freezer compartment 14. In the embodiment shown, the housing 30 is molded of plastic. As best seen in FIG. 5, a detent 34 is formed in a lower surface of the upper wall 30*a*. The detent 34 is dimensioned to receive a plate 32 that is used for mounting the ice maker 50 to the housing 30. In this respect, the plate 32 defines the position of the ice maker 50 within the freezer compartment 14.

The plate 32 includes a plurality of recesses 36 that are positioned and dimensioned to mate with a plurality of mounting feet 54 of the ice maker 50 (described in detail below) for securing the ice maker 50 to the housing 30. A central portion of plate 32 is formed to define a cavity 38. In the embodiment shown, the cavity 38 is generally rectangular in shape. An inner peripheral edge 38*a* of the plate 32 surrounding the cavity 38 is recessed to match an outer peripheral edge of a plate 124 of the water fill assembly 100, as described in detail below. Two recesses 38*b* are formed in opposite sides of the cavity 38 and are positioned and dimensioned to engage tabs 126 of a fill and heater assembly 120 to secure the fill and heater assembly 120 to the plate 32, as described in detail below. An opening (not shown) extends through a portion of the plate 32 that defines a top of the cavity 38. The opening is positioned and dimensioned to allow an outlet end 102*b* of a water fill tube 102 to extend through the opening and into cavity 38, as described in detail below.

Figure 6:
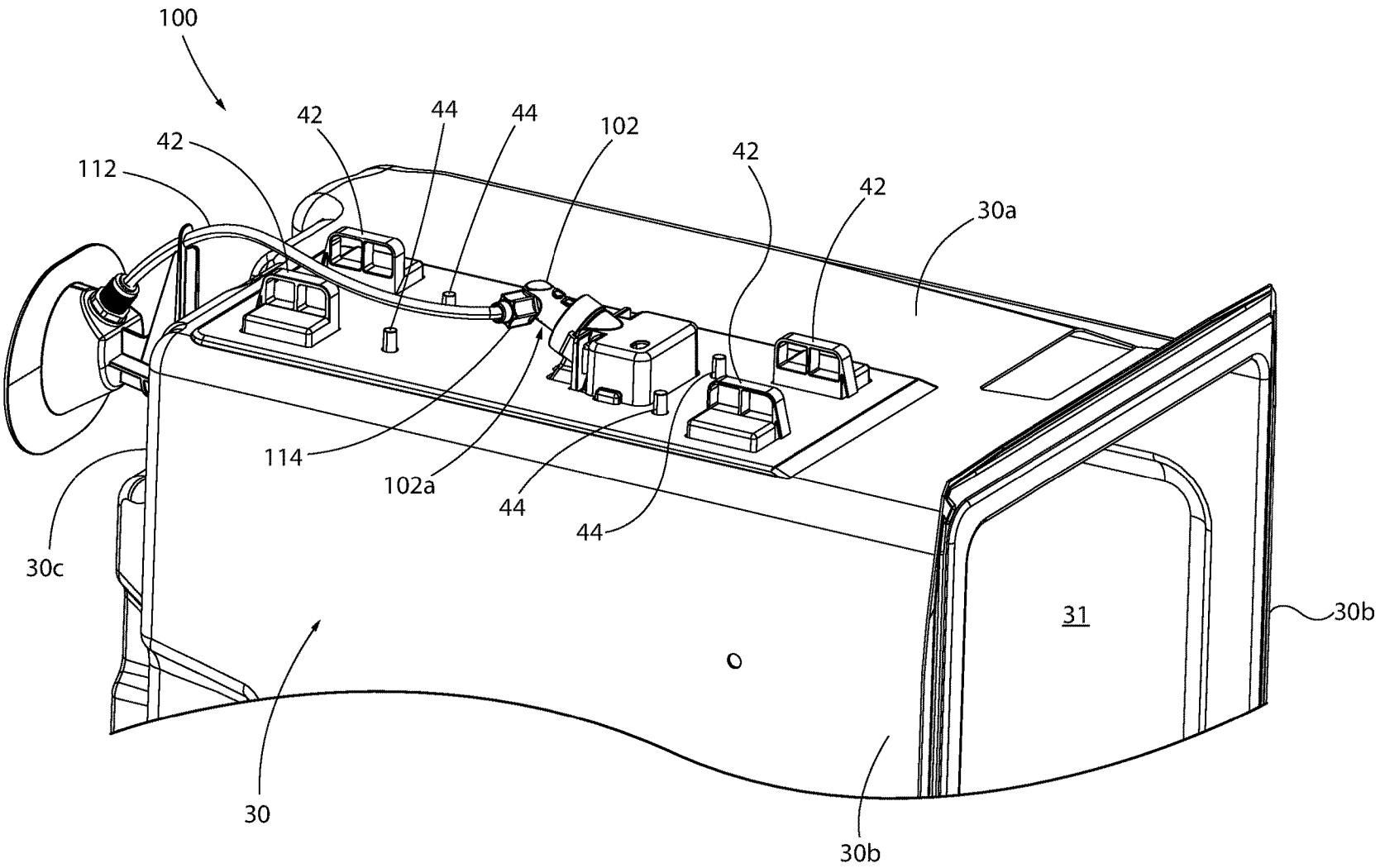
FIG. 6 is a perspective view of a top, outer wall of the freezer compartment housing of FIG. 2.

Referring now to FIG. 6, a plurality of mounting feet 42 and locating tabs 44 extend from an upper surface of the plate 32. Feet 42 and tabs 44 are provided for mounting the plate 32 to the upper wall 30*a* of the housing 30. Feet 42 and tabs 44 extend through openings formed in the upper wall 30*a* of housing 30. During assembly of the refrigerator 10, the housing 30 is placed within an exterior metal cabinet and an insulating foam (not shown) is injected into the void between the exterior metal housing and the housing 30 to cover an outer surface of the housing 30. The insulating foam is designed to flow and extend through the openings formed in the feet 42 such that feet 42 are encapsulated in the insulating foam. In this respect, the insulating foam (when cured) also serves as a mounting means for securing the plate 32 to the housing 30. The insulating foam also provides structural rigidity to the freezer compartment 14.

Referring back to FIGS. 3 and 4, the ice maker 50 is best seen. The ice maker 50 can be secured within the freezer compartment 14 to plate 32 using any suitable fastener. In the embodiment shown, a plurality of mounting feet 54 are formed in an upper surface of the ice maker 50. The mounting feet 54 are positioned and dimensioned to align with and mate with the plurality of recesses 36 formed in plate 32. An opening 56 is formed in an upper wall of the ice maker 50 and is positioned and dimensioned to align with the cavity 38 formed in the plate 32 when the ice maker 50 is mounted to the plate 32.

The ice maker 50 includes a generally rectangular frame defining an ice making chamber in which an ice making assembly is disposed. An ice bin 52 that stores ice pieces produced by the ice maker is selectively inserted into, removed from, and secured to the frame of the ice maker 50, as desired. Because the ice bin 52 is disposed within the freezer compartment 14, there is no need to provide a hermetic seal on a front cover of the ice bin 52. As such, any cold air in the ice bin 52 will be allowed to escape and circulate within the freezer compartment 14. In various other examples, a hidden latch may be desirable for cosmetic and ergonomic reasons.

Figure 4:
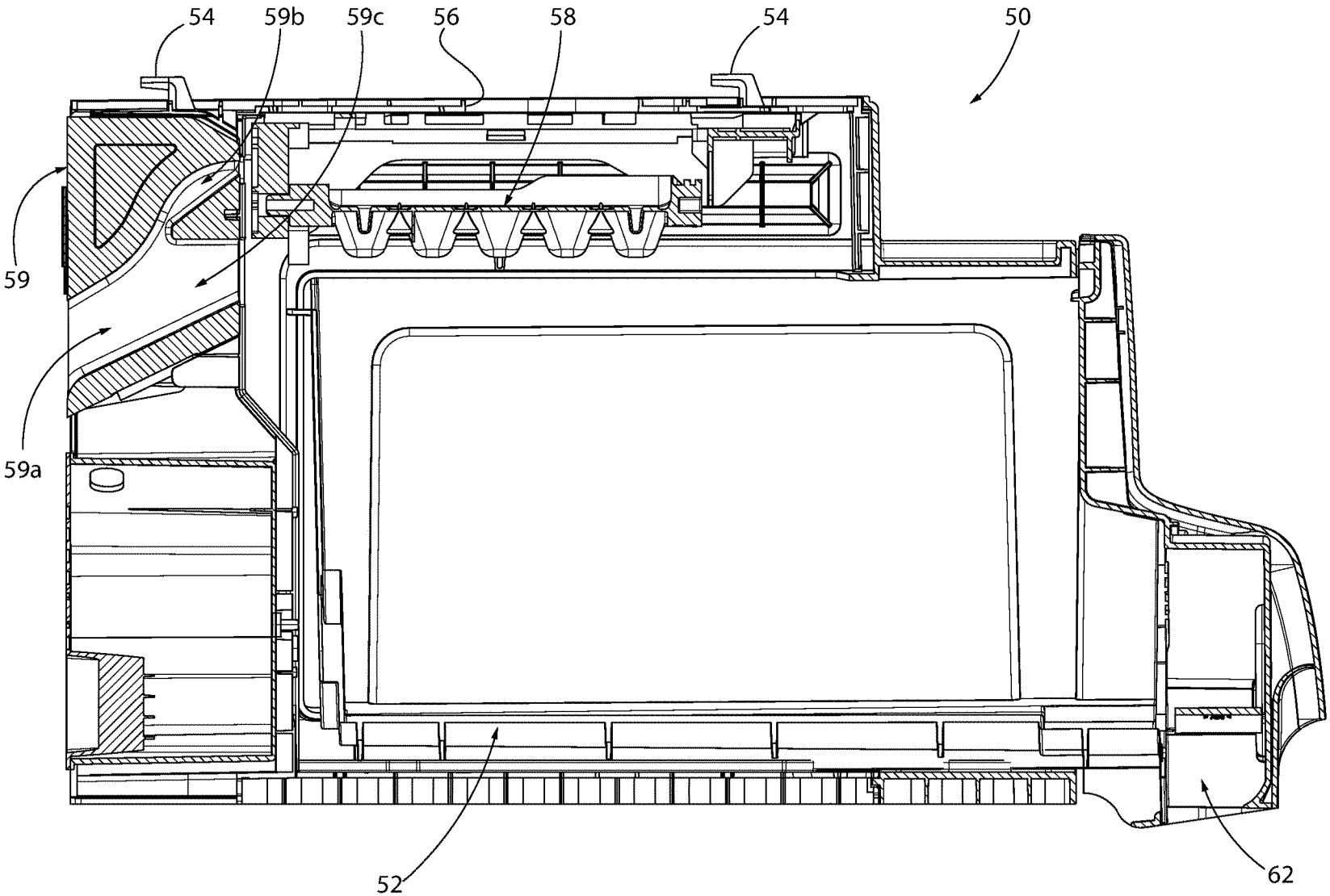
FIG. 4 is a section view of the ice maker of FIG. 3, taken along lines 4-4.

Referring now to FIG. 4, the ice maker 50 includes an ice tray or mold 58 for storing water to be frozen into the ice pieces. The ice tray 58 is positioned beneath the opening 56 formed in the upper wall of the ice maker 50. The ice tray 58 may be a twist-tray type, in which the ice tray 58 is rotated upside down and twisted along its longitudinal axis to thereby break the frozen ice pieces free from the ice reservoirs of the ice tray 58 where they fall into the ice bin 52 located below the ice tray 58. Still, a conventional metal ice tray with a plurality of sweeper-arms and a harvest heater for partially melting the ice pieces, or even other types of ice maker assemblies like the finger-evaporator type, may also be utilized.

The ice maker 50 includes a bail arm (not shown) for sensing the presence of ice pieces within the ice bin 52. The bail arm may actuate a switch to signify an upper limit and/or absence of ice pieces in the ice bin, and a driver, which includes an electric motor, for example, for driving the ice tray 58 between an ice-making position and an ice-harvesting position. A thermistor or other suitable temperature sensor operatively connected to the controller may be coupled to the ice tray 58, such as embedded within a recess formed in the ice tray 58, for determining the freezing status of the water contained in the ice tray 58 to facilitate ice harvesting. One or more switches are in the ice maker 50 to determine when the mold has reached a travel limit.

A cold air director 59 is disposed in the rear of the ice maker 50 for directing cold air into the ice maker 50. An inlet 59*a* of the director 59 is formed in a rear of the director 59 and fluidly connects to the evaporator (not shown.) The other end of the inlet 59*a* divides into a first outlet 59*b* and a second outlet 59*c* that extend through an opposite face of the cold air director 59. The cold air director 59 is positioned and dimensioned such that the first outlet 59*b* is in registry with a space above the ice tray 58 for conveying cold air over the ice tray 58 and the second inlet 59*c* is in registry with a space that is bounded by a bottom of the ice tray 58 and in the interior of the ice bin 52.

It is contemplated that the ice bin 52 may be removably installed in the ice maker 50 to grant access to ice pieces stored therein. An aperture 62 (best seen in FIG. 4) is formed along a front, bottom surface of the ice bin 52. Aperture 62 is positioned and dimensioned to align with the aperture 28*a* (shown in FIG. 1) in the ice chute 28 when the door 18 is in the closed position. As such, frozen ice pieces stored in the ice bin 52 are conveyed to the ice chute 28 and dispensed by the dispenser. It is contemplated that the ice maker 50 may include a rotatable auger (not shown) that extends along a length of the ice bin 52. Rotation of the auger urges the ice towards the aperture 62 formed along the front, bottom surface of the ice bin 52. The auger may be automatically activated and rotated by an electric motor in response to a request for ice pieces initiated by the user at the dispenser.

Turning now to FIGS. 6-11, the water fill assembly 100 which provides a supply of water to the ice tray 58, is shown. In general, the water fill assembly 100 includes a water fill tube 102, a water supply line 112 and a fill and heater assembly 120.

Figure 7:
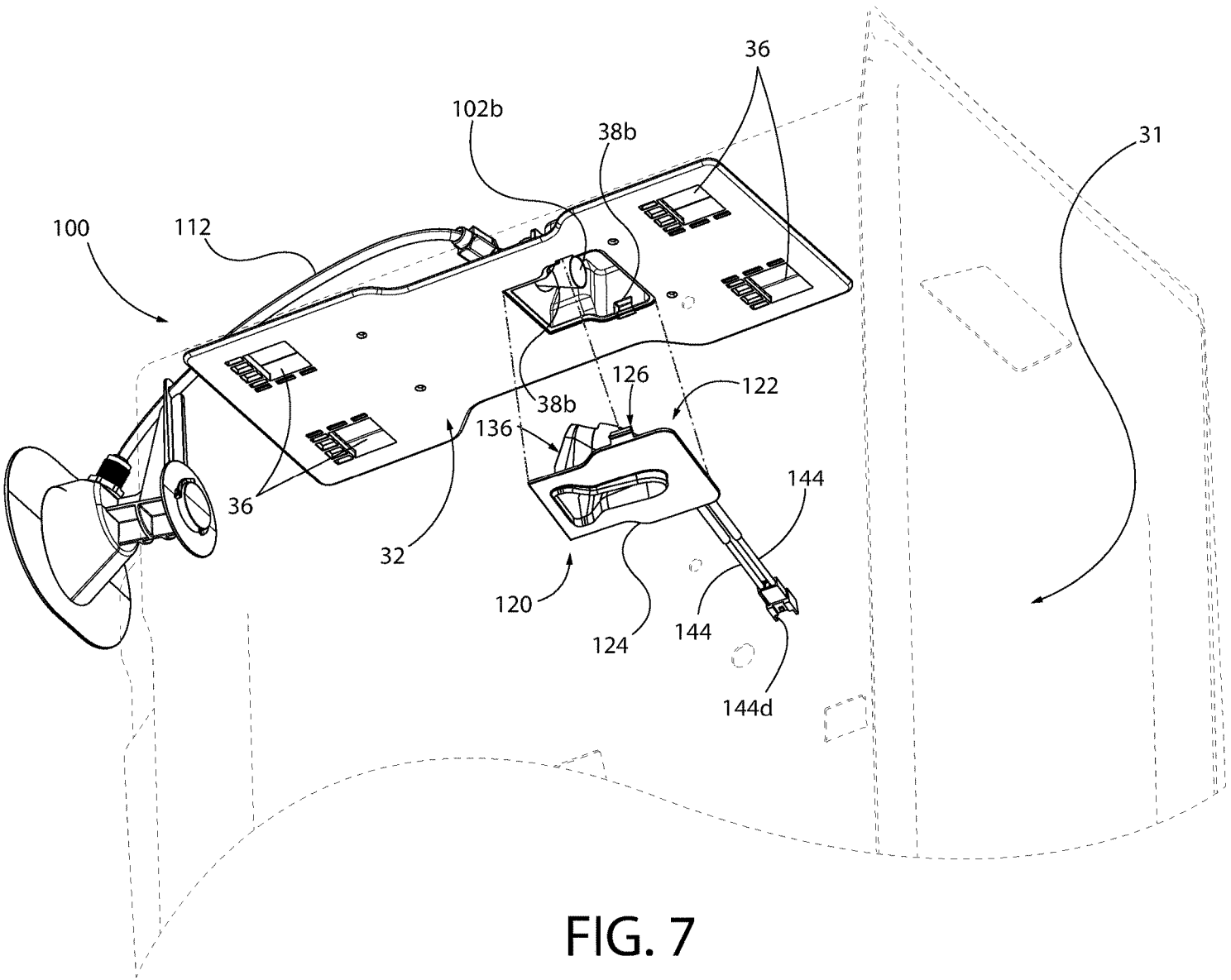
FIG. 7 is an exploded view of the freezer compartment housing and fill section heater.

The water fill tube 102 is an elongated tube-shaped element for conveying water from a water supply line 112 to the ice maker 50. The water fill tube 102 includes a connector for connection of the water fill tube 102 to the plate 32. In particular, as shown in FIG. 6, the water fill tube 102 is connected to the portion of the plate 32 that is formed to define cavity 38. An inlet end 102*a* of the water fill tube 102 includes a connecter that extends radially from a cylindrical side wall of the water fill tube 102. The connecter fluidly connects the water fill tube 102 to the water supply line 112. As shown in FIG. 7, an outlet end 102*b* of the water fill tube 102 is dimensioned to extend through an opening and into the cavity 38 formed in the plate 32 when the water fill tube 102 is mated to the plate 32.

The water supply line 112 extends from a source of water (such as a pressurized water line) to the inlet end 102*a* of the water fill tube 102. The water supply line 112 includes a fluid connector 114 for fluidly connecting to the connector on the inlet end 102*a* of the water fill tube 102. As such, water supply line 112 is provided for conveying water from the source of water to the water fill tube 102. The foregoing fluid connections are made prior to injecting the insulating foam into the void between the housing 30 and the exterior metal cabinet. As such, the insulating foam (when cured) serves to secure the water supply line 112 and the water fill tube 102 in place.

Referring now to FIGS. 7-11, the fill and heater assembly 120 is shown. In general, the fill and heater assembly 120 includes a water fill diverter 122 and a heating element 142.

Figure 8:
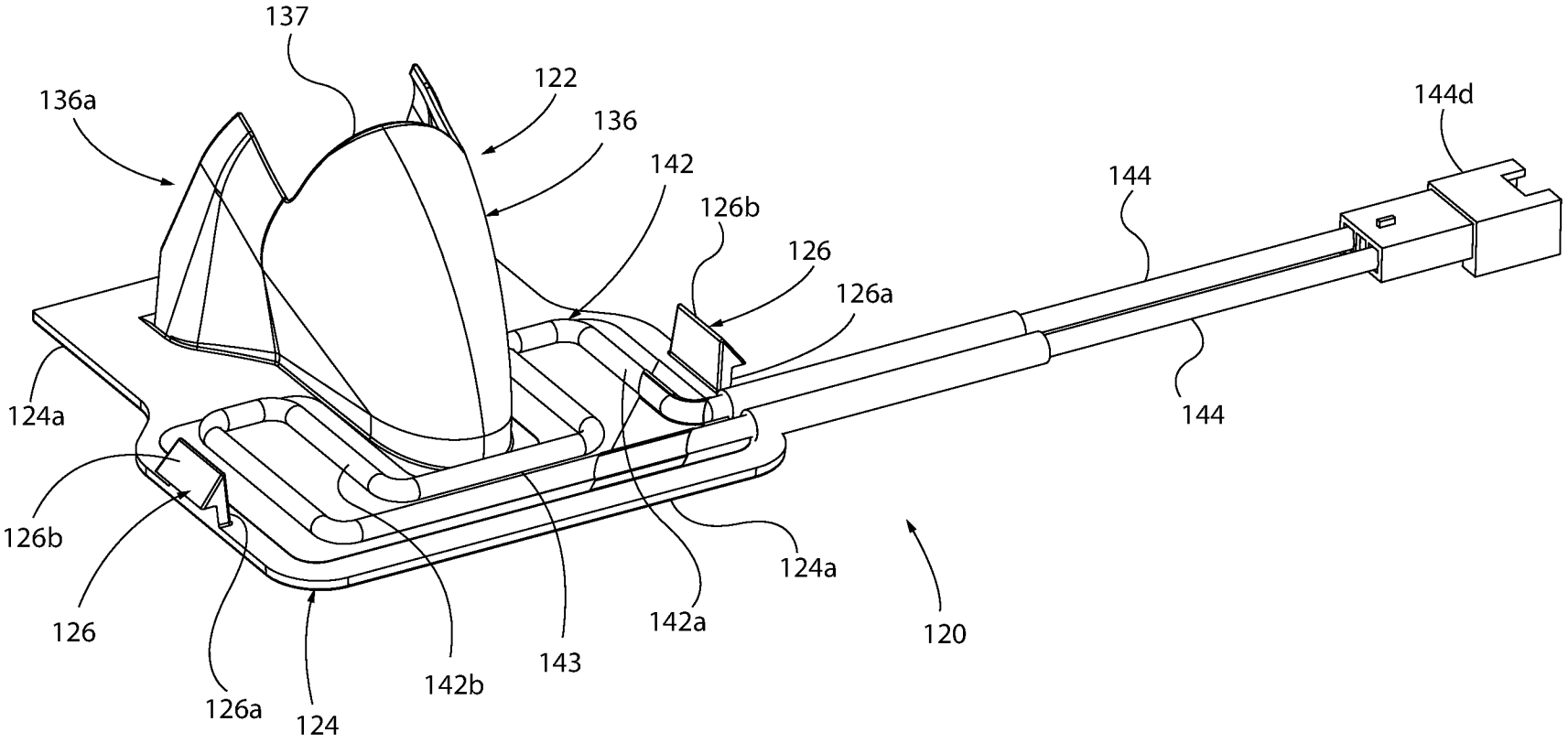
FIG. 8 is a top perspective view of the fill section heater of FIG. 7.

As shown in FIG. 8, the water fill diverter 122 includes a mounting plate 124 and a curved shroud 136 extending from a top surface of the mounting plate 124. The mounting plate 124 has an outer peripheral edge 124*a* that is contoured to match the recessed inner peripheral edge 38*a* of the plate 32 that defines an opening to the cavity 38. Two tabs 126 extend from the upper surface of the mounting plate 124 and are dimensioned and positioned to engage the recesses 38*b* formed in the opposite sides of the cavity 38 in the plate 32. Each tab 126 is disposed on an opposite edge of the mounting plate 124 and includes a rectangular-shaped base 126*a* and a triangular-shaped locking portion 126*b*. In the embodiment shown, the tabs 126 can be dimensioned to attach the water fill diverter 122 to the plate 32 in a snap-fit type manner. It is contemplated that other attachment methods, such as, but not limited to, fasteners, adhesive, etc., can be used to secure the water fill diverter 122 to the plate 32.

It is contemplated that the water fill diverter 122 may be attached to the plate 32 prior to securing the ice maker 50 into the housing 30. In this respect, the opening 56 in the top of the ice maker 50 can be dimensioned to be smaller than the water fill diverter 122 such that the upper surface of the ice maker 50 helps to secure or hold the water fill diverter 122 to the plate 32. It is also contemplated that the opening 56 in the top of the ice maker 50 may be large enough such that the water fill diverter 122 can fit through the opening 56, thereby allowing the water fill diverter 122 to be attached to the plate 32 after the ice maker 50 is attached to the housing 30.

Figure 9:
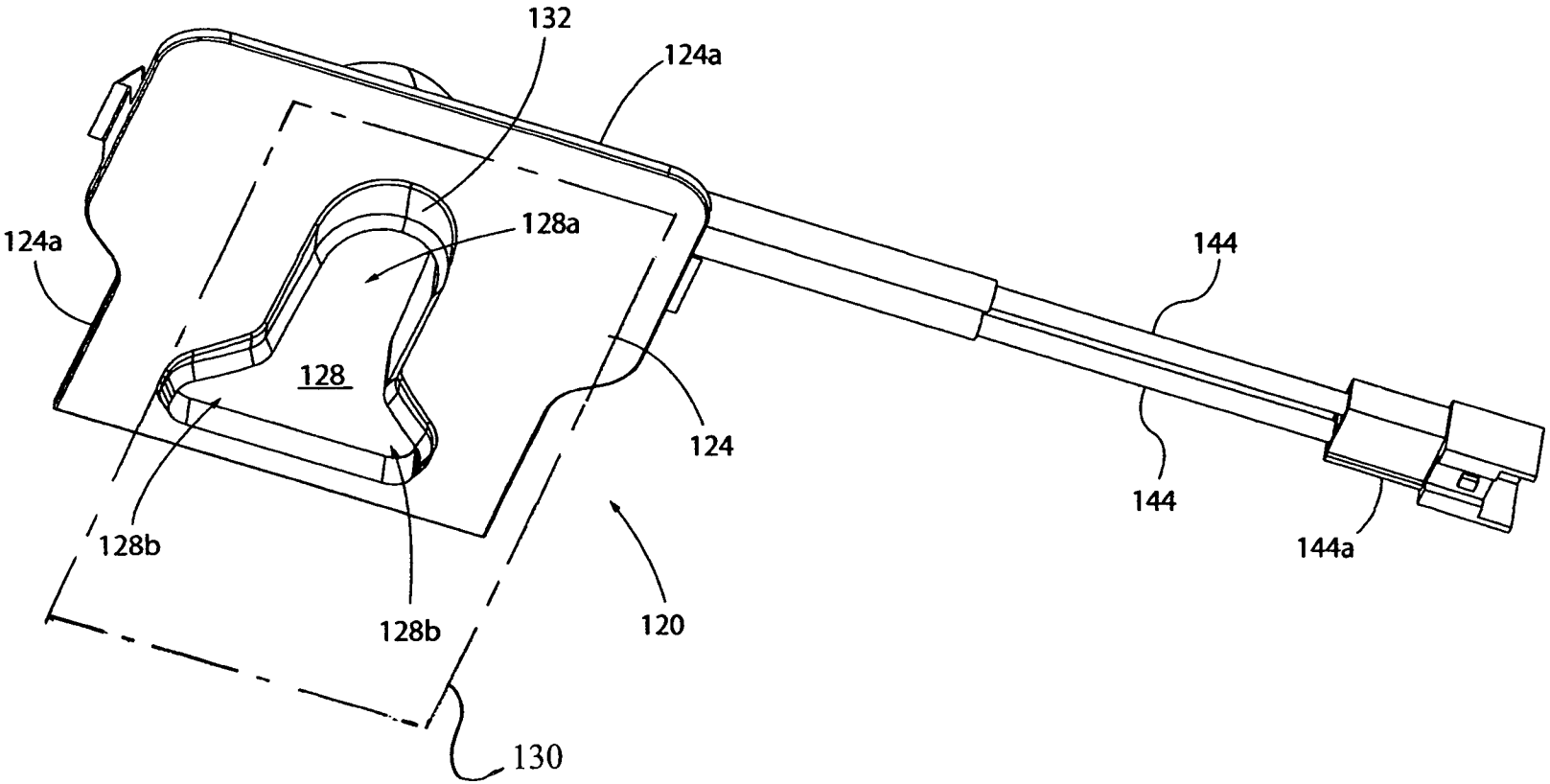
FIG. 9 is a bottom perspective view of the fill section heater of FIG. 7.
Figure 10:
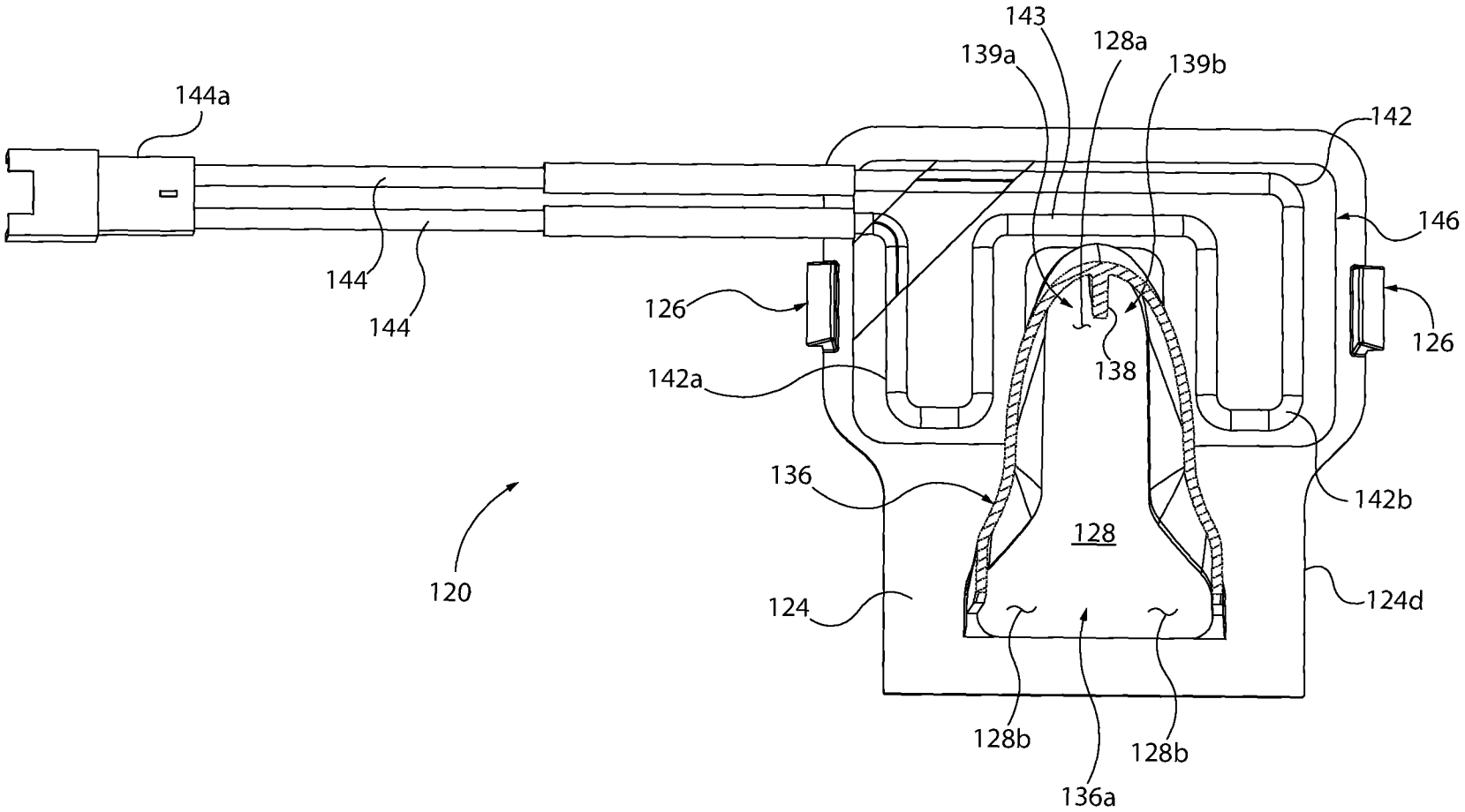
FIG. 10 is a top section view of the fill section heater of FIG. 7.

As shown in FIG. 9, an opening 128 extends through mounting plate 124. The opening 128 includes an elongated nose portion 128*a* extending to a first end of the opening 128 and two wing portions 128*b* extending in a direction generally transverse to the nose portion 128*a* at a second end of the opening 128. An outwardly extending flange 132 is disposed about an inner peripheral edge of the plate 124 that defines the opening 128. As such, the flange 132 has a shape similar to the opening 128.

In the embodiment shown, the lower edge of the flange 132 is sharp to enhance water separation from the flange 132. Moreover, in the embodiment shown, the flange 132 is longer or more pronounced around the nose portion 128*a* to aid in directing the water flowing thereby into a predetermined direction. In particular, the portion of the flange 132 disposed around the nose portion 128*a* extends further from the bottom surface of the plate 124 than the portions of the flange 132 disposed around the wings portions 128*b*. As such, gravity can cause residual water remaining on the flange 132 to collect at or near the portion of the flange 132 extending around the nose portion 128*a* of the opening 128, i.e., the first end of the opening 128. It is contemplated that the distance that the flange 132 extends from the bottom surface of the plate 124 may increase continuously from the wing portions 128*b*, i.e., the second end of the opening 128, to the nose portion 128*a*, i.e., the first end of the opening 128. It is also contemplated that, when viewing a side profile of the flange 132 with the nose portion 128*a* at one end and the wing portions 128*b* at an opposite end, the continuous increase in distance from the bottom surface of plate 124 can be linear in shape (i.e., uniform) or curved in shape (i.e., non-uniform).

It can be appreciated that, in the embodiment described above, when the plate 124 is attached to the plate 32, the plate 124 is parallel to a horizontal plane 130 (FIG. 9). As such, the portion of the flange 132 corresponding to the first end of the opening 128 is a first vertical distance above the horizontal plane 130 and the portion of the flange 132 corresponding to the second end of the opening 128 is a second vertical distance above the horizontal plane 130, wherein the first vertical distance is less than the second vertical distance. In other words, the flange 132 is positioned such that one portion of the flange 132 is lower than the remaining portions of the flange. In alternative embodiments, the distance between the bottom of the flange 132 and the plate 124 can be constant, so long as the plate 124 is skewed or angled relative to a horizontal plane when assembled into the housing 30. This positioning of the plate 124 will thereby cause the bottom edge of the flange 132 to be angled or skewed relative to the horizontal plane. This embodiment, therefore, also results in a first portion of the flange 132 being vertically lower than a remaining portion of the flange 132 so that gravity can cause residual water to collect at the first portion of the flange 132.

The curved shroud 136 extends from an upper surface of the plate 124. The curved shroud 136 defines a flow channel for directing water flowing there along into a predetermined direction and, preferably, into the ice tray 58 below. A base of the shroud 136 is dimensioned and positioned to extend from the inner peripheral edge of the plate 125 defining the opening 128. In this respect, the lower base portion of the shroud 136 has a shape that conforms to the opening 128 in the plate 124. The shroud 136 has an open end 136*a* that faces the wing portions 128*b* of opening 128. When viewed from the open end 136*a*, the shroud 136 has a U-shaped cross section that decreases in height toward the nose portion 128*a* of the opening 128. When viewed from the side, an upper surface of the shroud 136 is generally parabolic in shape. A notch 137 is formed in the open end 136*a* of the shroud 136. The notch 137 is dimensioned for allowing the shroud 136 to be inserted into the cavity 38 in the plate 32 and around the outlet end 102*b* of the water fill tube 102.

Figure 11:
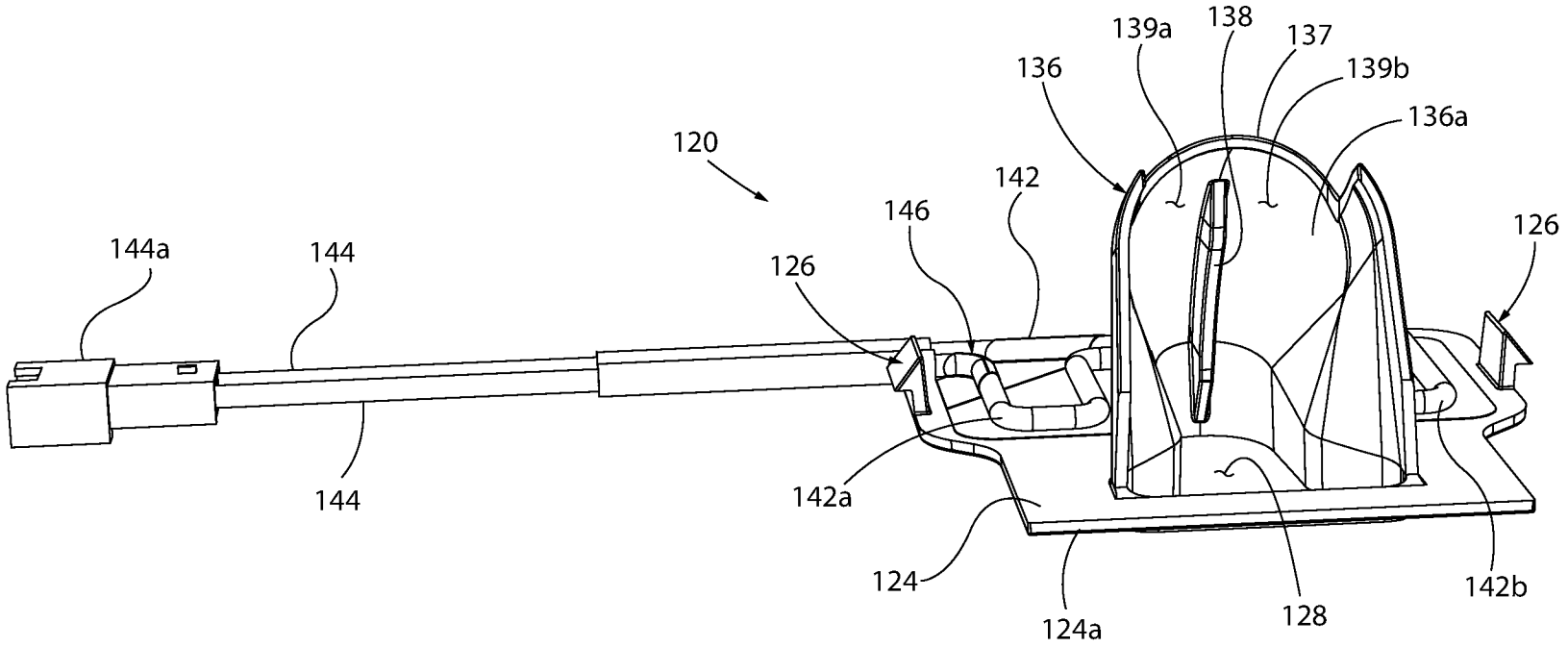
FIG. 11 is a rear perspective view of the fill section heater of FIG. 7.

An elongated wall 138 projects from an inner curved surface of the shroud 136 into the flow channel defined by the shroud 136. The wall 138 is positioned to extend longitudinally along an interior of the shroud 136 and to bisect the interior cavity of the shroud 136, as best seen in FIG. 11. In the embodiment shown, the wall 138 divides water flowing therealong into two flow streams which exit the nose portion 128*a* at areas 139*a*, 139*b*. It is contemplated that more than one wall may be disposed within the shroud 136 to provide more than two flow streams for directing the water flowing through the shroud 136 into a predetermined direction(s). In the embodiment shown, the wall 138 is generally planar in shape. It is contemplated that the wall 138 can have other shapes, such as, but not limited to, curved, to change or vary the flow characteristics of the water conveyed through the shroud 136 and into the ice tray 58.

As discussed in detail above, during operation of a conventional ice maker, residual water around an outlet end of a water fill line may freeze and form an ice dam that obstructs the flow of water from the water fill line. Moreover, the ice dam may cause the water to spray and create unwanted ice formations within the ice maker. The present apparatus includes a heating element 142 for maintaining the temperature at an exit end of the shroud 136 at a temperature that is in excess of 0° C.

In the embodiment shown, the heating element 142, for example, an electrical resistance heater, is disposed on the upper surface of the plate 124. The heating element 142 is positioned in close proximity to the lower edge of the shroud 136 where the shroud 136 attaches to the plate 124. In particular, a portion 143 of the heating element 142 is disposed at a location where a front edge of the shroud 136 meets the plate 124, i.e., along the nose portion 128*b* of the opening 128. In the embodiment shown, the portion of the flange 132 extending around the nose portion 128*a* extends further from the bottom surface of the plate 124 than the portion of the flange 132 extending around the wing portions 128*b*. As such, residual water is more likely to collect around the nose portion 128*a* of the opening 128, i.e., the location wherein the front edge of the shroud 136 meets the plate 124. Therefore, the portion 143 of the heating element 142 is disposed in close proximity to the nose portion 128*a* of the opening 128 to reduce the likelihood that residual water on or near the nose portion 128*a* will freeze and form an ice dam.

In the embodiment shown, the heating element 142 is an elongated rod-shaped element having a first U-shaped portion 142*a* disposed on one side of the shroud 136 and a second U-shaped portion 142*b* disposed on an opposite side of the shroud 136. It is contemplated that the heating element 142 can have other shapes and configurations so long as the portion of the plate 124 that engages the front edge of the shroud 136 (i.e., around the nose portion 128*a* of the opening 128) is maintained at a temperature in excess of about 0° C. For example, the heating element 142 can be any one of a flat elongated element, a coil-shaped element, a serpentine-shaped element, etc. to heat the plate 124 to the desired temperature. The heating element 142 includes a wire 144 having an electrical connector 144*a* disposed at and end thereof for connecting the heating element 142 to a source of power.

In the embodiment shown, a foil 146 is provided for securing the heating element 142 to the plate 124. The foil 146 can also be provided for aiding in the distribution of heat along the plate 124. In the embodiment shown, the foil 146 is an aluminum foil having a pressure sensitive adhesive on the side facing the plate 124. It is contemplated that the foil 146 may not be utilized and that the heating element 142 can be attached to the plate 124 using other methods, such as, but not limited to, clips for snapping the heating element 142 to the plate 124, an adhesive applied between the plate 124 and the heating element 142, fasteners for attaching the heating element 142 to the plate 124, etc.

Referring now to FIGS. 6 and 7, the water fill assembly 100 is attached to the plate 32. In particular, one end of the water supply line 112 is connected to a source of water and the opposite end is connected to the fluid connector on the water fill tube 102. The outlet end 102*b* of the water fill tube 102 is inserted into the cavity 38 when the water fill tube 102 is secured to the plate 32. Thereafter, the insulating foam (described in detail above) is injected into the void between the housing 20 and the exterior metal cabinet to secure the foregoing components.

Thereafter, the fill and heater assembly 120 is inserted into the cavity 38 in plate 32 from the internal chamber 31 of the housing 30 (see FIG. 7). Prior to fully inserting the fill and heater assembly 120 into the cavity 38, the electrical connector 144*a* is connected to a mating connector (not shown) that is disposed within or adjacent to the cavity 38. Thereafter, the locking portions 126*b* of the tabs 126 are inserted into the recesses 38*b* in the plate 32 to secure the fill and heater assembly 120 to the plate 32. In the embodiment shown, the tabs 126 and the recesses 38*b* are dimensioned to attach the fill and heater assembly 120 to the plate in a snap-fit like manner. As noted above, the outer peripheral edge 124*a* of the plate 124 corresponds to the recess formed in the inner peripheral edge 38*a* such that the lower surface of the plate 124, except the flange 132, is flush with the lower surface of plate 32. Thereafter, the ice maker 50 is installed into the housing 30, in particular, the ice maker 50 is attached to the upper wall 30*a* of the housing 30. As noted above, it is contemplated that the ice maker 50 can be installed first and, thereafter, the fill and heater assembly 120 can be attached to the plate 32.

During an ice making procedure, pressurized water is conveyed from the source of water through the water supply line 112 and to the water fill tube 102. The water exiting the water fill tube 102 is channeled by the inner surface of the shroud 136 such that the water flows smoothly along the inner surface of the shroud 136 and exits the shroud 136 along the flange 132. When the ice maker 50 is disposed in the freezer compartment 14, the water exiting the shroud 136 flows smoothly into the ice tray 58 positioned below the shroud 136. In the embodiment shown, the wall 138 in the shroud 136 divides the water flow into two streams defined by areas 139*a*, 139*b*. The two areas 139*a*, 139*b* are dimensioned to cause the water exiting the shroud 136 to have a desired flow characteristic as the water flows into the ice tray 58 below.

In addition to the foregoing, electrical power is supplied to the heating element 142 such that the portion of the flange 132 that extends around the nose portion 128*a* of the opening 128 is heated to a temperature in excess of 0° C. As such, the heating element 142 hinders the build-up of ice along the lower edge of the flange 132. This, in turn, allows the fill and heater assembly 120 to function for prolonged periods of time without failure from ice build-up.

It is contemplated that the heating element 142 may be energized in a variety of manners for maintaining the temperature of the lower edge of the flange 132 above a predetermined temperature. For example, the heating element 142 may run continuously or intermittently during operation of the refrigerator 10 and/or during operation of the ice maker 50. Alternatively, the electrical power supplied to the heating element 142 can be alternated between an "ON" state and an "OFF" state or run continuously during predetermined periods of time, such as, but not limited to, during a period of time before, during and/or after the pressurized water is conveyed through the water fill tube 102, during an ice making procedure, etc. It is also contemplated that the electrical power can be supplied to the heating element 142 in a manner such that the heating element 142 has a plurality of discrete "heat levels." For example, the heating element 142 may operate at a first heat level when water is injected into the ice tray 58, a second, different heat level for a predetermined time after the water has been injected into to the ice tray 58, and a third, different heat level after the ice has been formed in the ice tray 58. It is also contemplated that the heating element 142 can be turned OFF when the freezer is operating in a defrosting process.

An operator may replace the fill and heater assembly 120 from the internal chamber of the freezer compartment 14. In this respect, the operator need only unsnap the fill and heater assembly 120 from the plate 32, disconnected the connector 144*a* and remove the fill and heater assembly 120. As noted above, the fill and heater assembly 120 and the ice maker 50 can be dimensioned such that the fill and heater assembly 120 can be removed with or without first removing the ice maker 50. Thereafter, the operator may connect the connector of the replacement fill and heater assembly to the source of power and insert the replacement fill and heater assembly into the cavity 38 in the plate 32. In this respect, the fill and heater assembly can be replaced quickly without requiring that the freezer compartment be disassembled.

In addition or alternatively, the ice maker of the instant application, including the fill and heater assembly, may further be adapted to mounting and use on a freezer door. In this configuration, although still disposed within the freezer compartment, at least the ice maker (and possibly an ice bin) is mounted to the interior surface of the freezer door. It is contemplated that the ice mold and ice bin can be separated elements, in which one remains within the freezer cabinet and the other is on the freezer door.

Cold air can be ducted to the freezer door from an evaporator in the fresh food or freezer compartment, including the system evaporator. The cold air can be ducted in various configurations, such as ducts that extend on or in the freezer door, or possibly ducts that are positioned on or in the sidewalls of the freezer liner or the ceiling of the freezer liner. In one example, a cold air duct can extend across the ceiling of the freezer compartment, and can have an end adjacent to the ice maker (when the freezer door is in the closed condition) that discharges cold air over and across the ice mold. If an ice bin is also located on the interior of the freezer door, the cold air can flow downwards across the ice bin to maintain the ice pieces at a frozen state. The cold air can then be returned to the freezer compartment, or alternatively can be ducted back to the evaporator of the freezer compartment. A similar ducting configuration can also be used where the cold air is transferred via ducts on or in the freezer door. The ice mold can be rotated to an inverted state for ice harvesting (via gravity or a twist-tray) or may include a sweeper-finger type, and a heater can similarly be used. It is further contemplated that although cold air ducting from the freezer evaporator as described herein may not be used, a thermoelectric chiller or other alternative chilling device or heat exchanger using various gaseous and/or liquid fluids could be used in its place. In yet another alternative, a heat pipe or other thermal transfer body can be used that is chilled, directly or indirectly, by the ducted cold air to facilitate and/or accelerate ice formation in the ice mold. Of course, it is contemplated that the ice maker of the instant application could similarly be adapted for mounting and use on a freezer drawer.

Alternatively, it is further contemplated that the ice maker of the instant application, including the fill and heater assembly, could be used in a fresh food compartment, either within the interior of the cabinet or on a fresh food door. It is contemplated that the ice mold and ice bin can be separated elements, in which one remains within the fresh food cabinet and the other is on the fresh food door.

In addition or alternatively, cold air can be ducted from another evaporator in the fresh food or freezer compartment, such as the system evaporator. The cold air can be ducted in various configurations, such as ducts that extend on or in the fresh food door, or possibly ducts that are positioned on or in the sidewalls of the fresh food liner or the ceiling of the fresh food liner. In one example, a cold air duct can extend across the ceiling of the fresh food compartment, and can have an end adjacent to the ice maker (when the fresh food door is in the closed condition) that discharges cold air over and across the ice mold. If an ice bin is also located on the interior of the fresh food door, the cold air can flow downwards across the ice bin to maintain the ice pieces at a frozen state. The cold air can then be returned to the fresh food compartment, or alternatively can be ducted back to the compartment with the associated evaporator, such as a dedicated icemaker evaporator compartment or the freezer compartment. A similar ducting configuration can also be used where the cold air is transferred via ducts on or in the fresh food door. The ice mold can be rotated to an inverted state for ice harvesting (via gravity or a twist-tray) or may include a sweeper-finger type, and a heater can similarly be used. It is further contemplated that although cold air ducting from the freezer evaporator (or similarly a fresh food evaporator) as described herein may not be used, a thermoelectric chiller or other alternative chilling device or heat exchanger using various gaseous and/or liquid fluids could be used in its place. In yet another alternative, a heat pipe or other thermal transfer body can be used that is chilled, directly or indirectly, by the ducted cold air to facilitate and/or accelerate ice formation in the ice mold. Of course, it is contemplated that the ice maker of the instant application could similarly be adapted for mounting and use on a fresh food drawer.

The invention has been described with reference to the example embodiments described above. Modifications and alterations will occur to others upon a reading and understanding of this specification. Examples embodiments incorporating one or more aspects of the invention are intended to include all such modifications and alterations insofar as they come within the scope of the appended claims.

What is claimed is:

1. A refrigeration appliance comprising:

a freezer compartment for storing food items in a sub-freezing environment having a target temperature below zero degrees Centigrade; and an ice maker disposed within the freezer compartment for freezing water into ice pieces, the ice maker comprising a water fill assembly for conveying water from a source of pressurized water to an ice tray disposed in the ice maker, the water fill assembly comprising:

a water fill tube having an inlet end fluidly connected to the source of pressurized water and an outlet end; and a removable fill and heater assembly comprising:

a plate disposed above the ice tray of the ice maker, the plate having an opening positioned above the ice tray;

a shroud extending from an upper surface of the plate about an outer periphery of the opening in the plate, the shroud defining a flow channel that extends from an inlet end to a single outlet end of the shroud, the inlet end of the shroud fluidly communicating with the outlet end of the water fill tube and the single outlet end of the shroud oriented toward the ice tray for directing water into the ice tray in a predetermined direction, the shroud including a notch formed in a wall of the shroud for allowing the outlet end of the water fill tube to freely pass through the wall to the flow channel, wherein an outer surface of the outlet end of the water fill tube is freed and spaced from the shroud when the shroud is positioned in the ice maker;

at least one wall disposed in the flow channel of the shroud for maintaining uniform flow of the water to the single outlet of the shroud; and a heating element disposed on the upper surface of the plate for applying heat to the plate thereby maintaining at least a portion of the plate at a temperature in excess of zero degrees Centigrade, the heating element including a first portion disposed at a location where a curved portion of the shroud intersect a nose portion of the opening in the plate.

2. The refrigeration appliance of claim 1, wherein a flange extends from a bottom surface of the plate about the outer periphery of the opening in the plate.

3. The refrigeration appliance of claim 2, wherein the plate is disposed within the ice maker such that a bottom edge of the flange is at a first vertical distance above a horizontal plane at a first end of the opening and at a second vertical distance above the horizontal plane at a second end of the opening, the first vertical distance being less than the second vertical distance for collecting residual water at the first end of the opening.

4. The refrigeration appliance of claim 3, wherein the bottom edge of the flange increases continuously in vertical distance above the horizontal plane from the first end of the opening to the second end of the opening.

5. The refrigeration appliance of claim 4, wherein the bottom edge of the flange increases uniformly in vertical distance above the horizontal plane from the first end of the opening to the second end of the opening.

6. The refrigeration appliance of claim 2, wherein the flange has a sharp bottom edge.

7. The refrigeration appliance of claim 2, wherein the flange has a first portion extending further from the bottom surface of the plate than a remaining portion of the flange for collecting residual water at the first portion of the flange.

8. The refrigeration appliance of claim 7, wherein the first portion of the flange corresponds to a front edge of the shroud.

9. The refrigeration appliance of claim 7, wherein the portion of the plate heated to a temperature in excess of zero degrees Centigrade corresponds to the first portion of the flange.

10. The refrigeration appliance of claim 1, wherein the at least one wall is axially aligned with the flow channel of the shroud.

11. The refrigeration appliance of claim 1, further comprising a foil having an adhesive for securing the heating element to the plate and for distributing heat generated by the heating element about the plate.

12. The refrigeration appliance of claim 1, further comprising at least one tab for attaching the plate to an upper wall of the freezer compartment in a snap-fit like manner.

13. The refrigeration appliance of claim 1, wherein the outlet end of the water fill tube is oriented toward the outlet end of the shroud.

14. The refrigeration appliance of claim 1, wherein the water flows longitudinally along both sides of the at least one wall of the shroud.

15. The refrigeration appliance of claim 1, wherein the heating element has a U-shaped profile with a second portion and a third portion of the heating element disposed on opposite sides of the nose portion of the opening.

16. A method of making ice in a refrigeration appliance, comprising the steps of:

inserting a shroud into an upper wall of an ice maker of the refrigeration appliance, the shroud including a notch formed in a wall of the shroud wherein an outlet end of a water fill tube freely passes through the wall of the shroud when the shroud is attached to the upper wall, wherein an outer surface of the outlet end of the water fill tube is freed and spaced from the shroud when the shroud is positioned in the ice maker;

introducing water into the shroud, the shroud defining a flow channel that extends from an inlet end to a single outlet end of the shroud, the single outlet end disposed about an outer periphery of an opening extending through a plate, the opening in the plate being positioned above an ice tray disposed within the ice maker wherein water supplied to the inlet end of the shroud flows along the flow channel of the shroud to the single outlet end of the shroud and into the ice tray, the shroud including at least one wall disposed in the flow channel of the shroud for maintaining uniform flow of the water to the single outlet of the shroud; and heating the plate to a temperature sufficient to prevent water from forming ice about the opening extending through the plate using a heating element having a first portion disposed at a location where a curved portion of the shroud intersect a nose portion of the opening in the plate.

17. The method of claim 16, wherein the step of heating includes heating the plate to a temperature in excess of about zero degrees Centigrade.

18. The method of claim 16, wherein the water flows longitudinally along both sides of the at least one wall of the shroud.

19. The method of claim 16, wherein the heating element has a U-shaped profile with a second portion and a third portion of the heating element disposed on opposite sides of the nose portion of the opening.

* * * * *